US011127245B2

(12) United States Patent
Baker et al.

(10) Patent No.: US 11,127,245 B2
(45) Date of Patent: Sep. 21, 2021

(54) COMPACT GAME DISPLAY SYSTEM WITH VIRTUAL DEPTH AUGMENTATION

(71) Applicant: SG Gaming, Inc., Las Vegas, NV (US)

(72) Inventors: Thomas Baker, Las Vegas, NV (US); Robert Glenn, Chicago, IL (US); Brian Goldstein, Las Vegas, NV (US); Paul Lesley, Chicago, IL (US); Timothy Loose, Chicago, IL (US); Abraham Usi, Las Vegas, NV (US); Bran Ferren, Beverly Hills, CA (US); Michael Keesling, Agoura Hills, CA (US); Donald Lariviere, Glendale, CA (US); Robert Liebersbach, Glendale, CA (US); Andrew McGraw, Newbury Park, CA (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/580,000

(22) Filed: Sep. 24, 2019

(65) Prior Publication Data

US 2020/0111299 A1 Apr. 9, 2020

Related U.S. Application Data

(60) Provisional application No. 62/740,729, filed on Oct. 3, 2018.

(51) Int. Cl.
*G07F 17/32* (2006.01)

(52) U.S. Cl.
CPC ..... *G07F 17/3216* (2013.01); *G07F 17/3211* (2013.01); *G07F 17/3223* (2013.01)

(58) Field of Classification Search
CPC ..... G07F 17/3216; G07F 17/3211; G07F 17/3223
See application file for complete search history.

(56) References Cited

U.S. PATENT DOCUMENTS 5,580,055 A * 12/1996 Hagiwara ..... G07F 17/3211 273/143 R
5,752,881 A * 5/1998 Inoue ..... G07F 17/3211 273/143 R
6,027,115 A * 2/2000 Griswold ..... G07F 17/3211 273/143 R (Continued)

*Primary Examiner* — Omkar A Deodhar
*Assistant Examiner* — Matthew D Hoel

(57) ABSTRACT

A gaming machine includes a cabinet at least partially defining a cavity opening and an internal cavity at least partially visible through the cavity opening, a primary display, a secondary display positioned within the internal cavity and visible through the cavity opening, a display movement assembly coupled to the primary display, and logic circuitry. The display movement assembly selectively moves the primary display between an open position and a closed position in which the primary display blocks visibility through the cavity opening. The logic circuitry causes the primary display in the closed position to present a first portion of a game, causes the display movement assembly to move the primary display to the open position to expose the cavity opening and the secondary display, and, in response to the secondary display being exposed, causes the secondary display to present a second portion of the game.

20 Claims, 11 Drawing Sheets

(56) References Cited

U.S. PATENT DOCUMENTS 6,036,188 A * 3/2000 Gomez ..... A63F 7/027 273/118 A
6,086,066 A * 7/2000 Takeuchi ..... G07F 17/3211 273/138.2
6,164,645 A * 12/2000 Weiss ..... G07F 17/3211 273/138.2
6,254,481 B1 7/2001 Jaffe
6,712,694 B1 3/2004 Nordman
6,817,946 B2 * 11/2004 Motegi ..... G07F 17/3211 273/138.1
6,937,298 B2 * 8/2005 Okada ..... G07F 17/32 349/58
7,140,963 B2 * 11/2006 Kojima ..... G07F 17/3211 463/20
7,159,865 B2 * 1/2007 Okada ..... G07F 17/3211 273/138.1
7,160,187 B2 * 1/2007 Loose ..... G07F 17/3202 463/20
7,166,029 B2 * 1/2007 Enzminger ..... G07F 17/3211 273/143 R
7,204,753 B2 * 4/2007 Ozaki ..... G07F 17/3206 273/274
7,255,643 B2 * 8/2007 Ozaki ..... G07F 17/3206 273/274
7,510,475 B2 3/2009 Loose et al.
7,744,460 B2 * 6/2010 Walker ..... G07F 17/3213 463/21
7,841,944 B2 * 11/2010 Wells ..... G07F 17/3211 463/37
7,887,408 B2 * 2/2011 Walker ..... G07F 17/3213 463/20
7,951,001 B2 * 5/2011 Wells ..... G07F 17/3211 463/33
8,016,669 B2 * 9/2011 Okada ..... G07F 17/3202 463/30
8,096,867 B2 * 1/2012 Okada ..... G07F 17/32 463/20
8,115,700 B2 * 2/2012 Schlottmann ..... G07F 17/3211 345/4
8,118,674 B2 2/2012 Burak et al.
8,123,609 B2 * 2/2012 Sekiguchi ..... G07F 17/3213 463/20
8,172,400 B2 5/2012 O'Connell et al.
8,199,068 B2 * 6/2012 Williams ..... G07F 17/3211 345/6
8,210,922 B2 * 7/2012 Williams ..... G07F 17/3211 463/20
8,216,068 B2 * 7/2012 Kishi ..... G07F 17/3211 463/31
8,241,121 B2 * 8/2012 Tanimura ..... G07F 17/3211 463/31
8,241,124 B2 8/2012 Kelly et al.
8,272,957 B2 * 9/2012 Crowder, Jr. ..... G07F 17/3211 463/32
8,298,081 B1 * 10/2012 Merritt ..... G07F 17/3211 463/33
8,337,286 B2 * 12/2012 Imura ..... G07F 17/3211 463/16
8,357,033 B2 * 1/2013 Williams ..... G07F 17/3209 463/20
8,360,847 B2 * 1/2013 Williams ..... G07F 17/34 463/20
8,512,139 B2 * 8/2013 Williams ..... G07F 17/3211 463/32
8,605,114 B2 * 12/2013 Schlottmann ..... G07F 17/3211 345/629
8,616,953 B2 * 12/2013 Yi ..... G07F 17/34 463/20
8,692,738 B2 4/2014 Smithwick et al.
8,715,058 B2 * 5/2014 Pennington ..... G07F 17/3216 463/20
8,734,260 B2 5/2014 Pececnik
8,749,582 B2 * 6/2014 Schlottmann ..... G07F 17/3211 345/629
8,758,144 B2 * 6/2014 Williams ..... G02F 1/133602 463/46
8,847,984 B2 9/2014 Boorman et al.
8,888,591 B2 * 11/2014 dos Santos ..... G07F 17/3213 463/31
8,974,297 B2 3/2015 Massing et al.
9,117,335 B2 * 8/2015 Crowder, Jr. ..... G07F 17/3211
9,652,928 B2 5/2017 Bernard et al.
2002/0175466 A1 * 11/2002 Loose ..... G07F 17/3213 273/143 R
2003/0060269 A1 * 3/2003 Paulsen ..... G07F 17/3211 463/20
2003/0087690 A1 * 5/2003 Loose ..... H04L 67/38 463/20
2003/0157980 A1 * 8/2003 Loose ..... G07F 17/3213 463/20
2004/0029636 A1 * 2/2004 Wells ..... G07F 17/3211 463/32
2004/0147303 A1 * 7/2004 Imura ..... G07F 17/3211 463/16
2004/0150162 A1 * 8/2004 Okada ..... G07F 17/3211 273/292
2004/0152502 A1 * 8/2004 Okada ..... G07F 17/3211 463/16
2004/0166925 A1 * 8/2004 Emori ..... G07F 17/3211 463/20
2004/0166926 A1 * 8/2004 Adachi ..... G07F 17/3267 463/20
2004/0171418 A1 * 9/2004 Okada ..... G07F 17/3211 463/20
2004/0198485 A1 * 10/2004 Loose ..... G07F 17/3211 463/20
2004/0207154 A1 * 10/2004 Okada ..... G07F 17/3227 273/138.1
2004/0209666 A1 * 10/2004 Tashiro ..... G07F 17/3211 463/20
2004/0209667 A1 * 10/2004 Emori ..... G07F 17/3211 463/20
2004/0209668 A1 * 10/2004 Okada ..... G07F 17/3211 463/20
2004/0209670 A1 * 10/2004 Adachi ..... G07F 17/3213 463/20
2004/0209678 A1 * 10/2004 Okada ..... G07F 17/32 463/30
2004/0209681 A1 * 10/2004 Emori ..... G07F 17/3211 463/31
2004/0214635 A1 * 10/2004 Okada ..... G07F 17/3202 463/30
2004/0214637 A1 * 10/2004 Nonaka ..... G07F 17/3211 463/31
2004/0227286 A1 * 11/2004 Tanimura ..... G07F 17/3211 273/143 R
2004/0227866 A1 * 11/2004 Okada ..... G07F 17/32 349/58
2004/0229680 A1 * 11/2004 Hoshino ..... G07F 17/32 463/20
2004/0229686 A1 * 11/2004 Tanimura ..... G07F 17/3211 463/30
2004/0248648 A1 12/2004 Rothschild et al.
2004/0266510 A1 * 12/2004 Kojima ..... G07F 17/34 463/16
2004/0266515 A1 * 12/2004 Gauselmann ..... G07F 17/3211 463/20
2004/0266521 A1 * 12/2004 Kojima ..... G07F 17/3211 463/20
2005/0032571 A1 * 2/2005 Asonuma ..... G07F 17/3211 463/20
2005/0153775 A1 * 7/2005 Griswold ..... G07F 17/3211 463/30
2005/0255908 A1 * 11/2005 Wells ..... G07F 17/3211 463/20
2005/0272500 A1 * 12/2005 Tanimura ..... G07F 17/34 463/20

(56) References Cited

U.S. PATENT DOCUMENTS

| | | | | |
|---|---|---|---|---|
| 2005/0282616 | A1* | 12/2005 | Tanimura | G07F 17/3211 463/20 |
| 2005/0282617 | A1* | 12/2005 | Sekiguchi | G07F 17/3213 463/20 |
| 2006/0014580 | A1* | 1/2006 | Hawthorn | G07F 17/3211 463/20 |
| 2006/0100013 | A1* | 5/2006 | Enzminger | G07F 17/3213 463/30 |
| 2006/0128467 | A1* | 6/2006 | Thomas | G07F 17/3211 463/31 |
| 2006/0135248 | A1* | 6/2006 | Anderson | G07F 17/3213 463/22 |
| 2006/0252496 | A1* | 11/2006 | Rasmussen | G07F 17/3216 463/20 |
| 2006/0281530 | A1* | 12/2006 | Seelig | G07F 17/3267 463/20 |
| 2007/0004513 | A1* | 1/2007 | Wells | G07F 17/3216 463/31 |
| 2007/0054730 | A1* | 3/2007 | Mattice | G07F 17/3211 463/16 |
| 2008/0004104 | A1* | 1/2008 | Durham | G07F 17/3202 463/20 |
| 2008/0020840 | A1 | 1/2008 | Wells et al. | |
| 2009/0075721 | A1* | 3/2009 | Pacey | G07F 17/34 463/20 |

* cited by examiner

COMPACT GAME DISPLAY SYSTEM WITH VIRTUAL DEPTH AUGMENTATION

CROSS-REFERENCE TO RELATED APPLICATIONS

This patent application claims the benefit of priority of U.S. Provisional Patent Application Ser. No. 62/740,729 filed on Oct. 3, 2018, the contents of which are hereby incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2018, Bally Gaming, Inc.

FIELD OF THE DISCLOSURE

The present invention relates generally to gaming systems, apparatus, and methods and, more particularly, to game display systems with hidden displays and virtual depth augmentation.

BACKGROUND

The gaming industry depends upon player participation. As the number of gaming machines and apparatuses available to players grow, the competition between the gaming machines to attract and retain players grows. As a result, advancements in game mechanics, software (e.g., network and display software), hardware, and other features, in combination with various artwork and presentation features, may be used to differentiate a particular gaming machine from the competition. The development of a gaming machine and/or an associated game may attempt to strike a balance between new and unique features and well-established features familiar to players to avoid overwhelming players playing for the first time.

As the industry matures, the creativity and ingenuity required to improve such operation and development of gaming machines and games grows accordingly.

SUMMARY OF THE DISCLOSURE

According to one aspect of the present disclosure, a gaming machine includes a cabinet at least partially defining a cavity opening and an internal cavity at least partially visible through the cavity opening, a primary display, a secondary display positioned within the internal cavity and visible through the cavity opening, a display movement assembly coupled to the primary display, and logic circuitry. The display movement assembly selectively moves the primary display between an open position and a closed position in which the primary display blocks visibility through the cavity opening. The logic circuitry causes the primary display in the closed position to present a first portion of a game, causes the display movement assembly to move the primary display to the open position to expose the cavity opening and the secondary display, and, in response to the secondary display being exposed, causes the secondary display to present a second portion of the game.

According to another aspect of the present disclosure, a method of revealing hidden displays using a gaming machine is provided. The gaming machine includes a cabinet at least partially defining an internal cavity and a cavity opening, a primary display, and a secondary display positioned within the internal cavity and visible through the cavity opening. The method includes moving, by a display movement mechanism, the primary display to a closed position to block visibility through the cavity opening to the secondary display, presenting, by the primary display in the closed position, a first portion of a game, in response to one or more trigger conditions, moving, by the display movement assembly, the primary display to an open position to expose the cavity opening and the secondary display, and in response to the secondary display being exposed, presenting, by the secondary display, a second portion of the game.

According to a further aspect of the present disclosure, a gaming system includes a gaming machine and logic circuitry. The gaming machine includes a cabinet at least partially defining a cavity opening and an internal cavity at least partially visible through the cavity opening, a primary display, a secondary display positioned within the internal cavity and visible through the cavity opening, and a display movement assembly coupled to the primary display. The display movement assembly selectively moves the primary display between an open position and a closed position in which the primary display blocks visibility through the cavity opening. The logic circuitry causes the primary display in the closed position to present a first portion of a game, causes the display movement assembly to move the primary display to the open position to expose the cavity opening and the secondary display, and, in response to the secondary display being exposed, causes the secondary display to present a second portion of the game.

Additional aspects of the invention will be apparent to those of ordinary skill in the art in view of the detailed description of various embodiments, which is made with reference to the drawings, a brief description of which is provided below.

Figure 1:
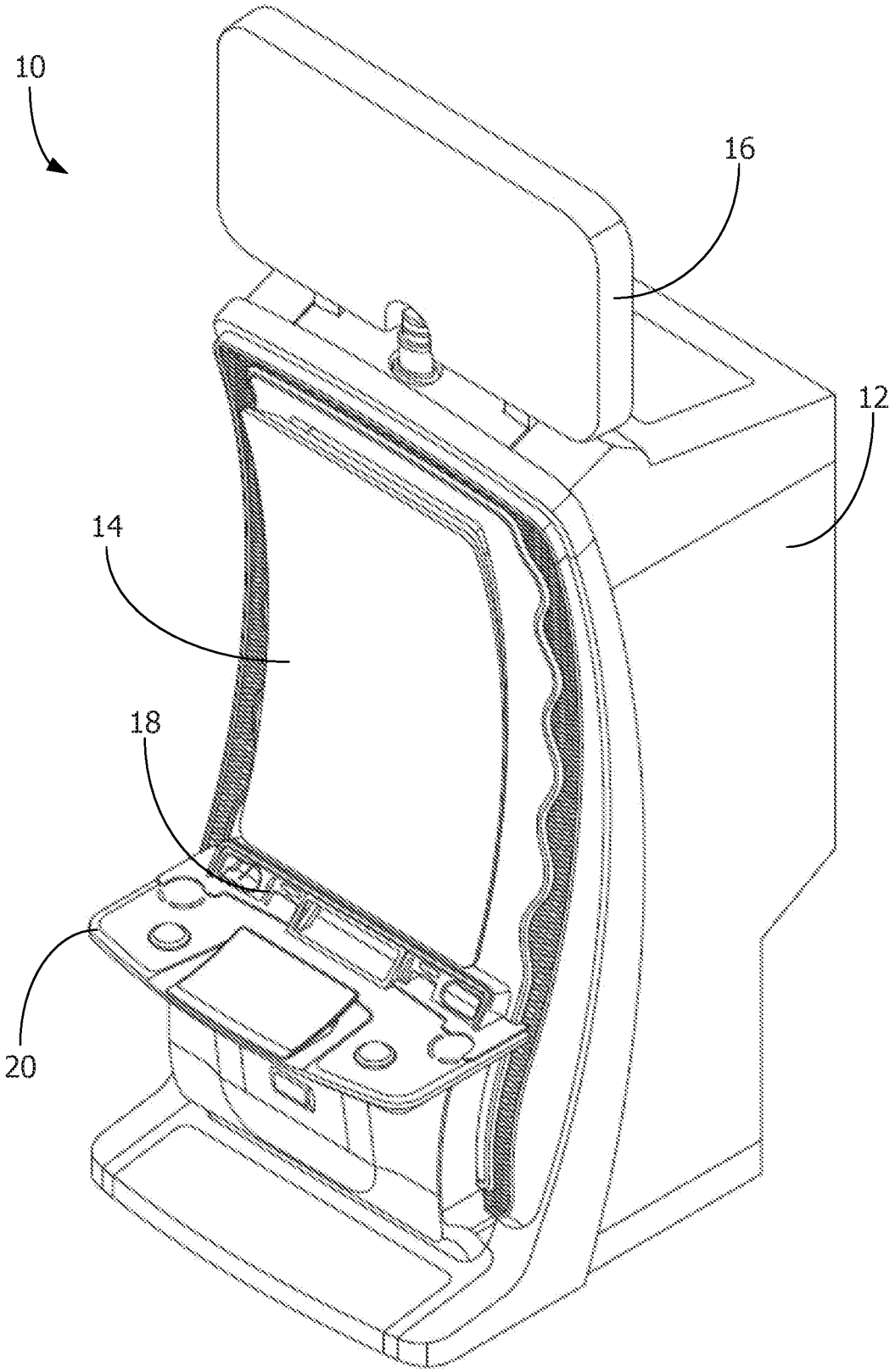
FIG. 1 is a perspective view of a free-standing gaming machine according to an embodiment of the disclosed concepts.

While the systems and methods described herein are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

FIG. 1 is a perspective view of an example gaming machine 10 according to at least one embodiment. Although the depicted gaming machine 10 is a floor-standing, cabinet-based machine, the gaming machine 10 may be any type of gaming terminal or machine and may have varying structures and methods of operation in accordance with the details described herein. For example, in some embodiments, the gaming machine 10 is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc.

Figure 6:
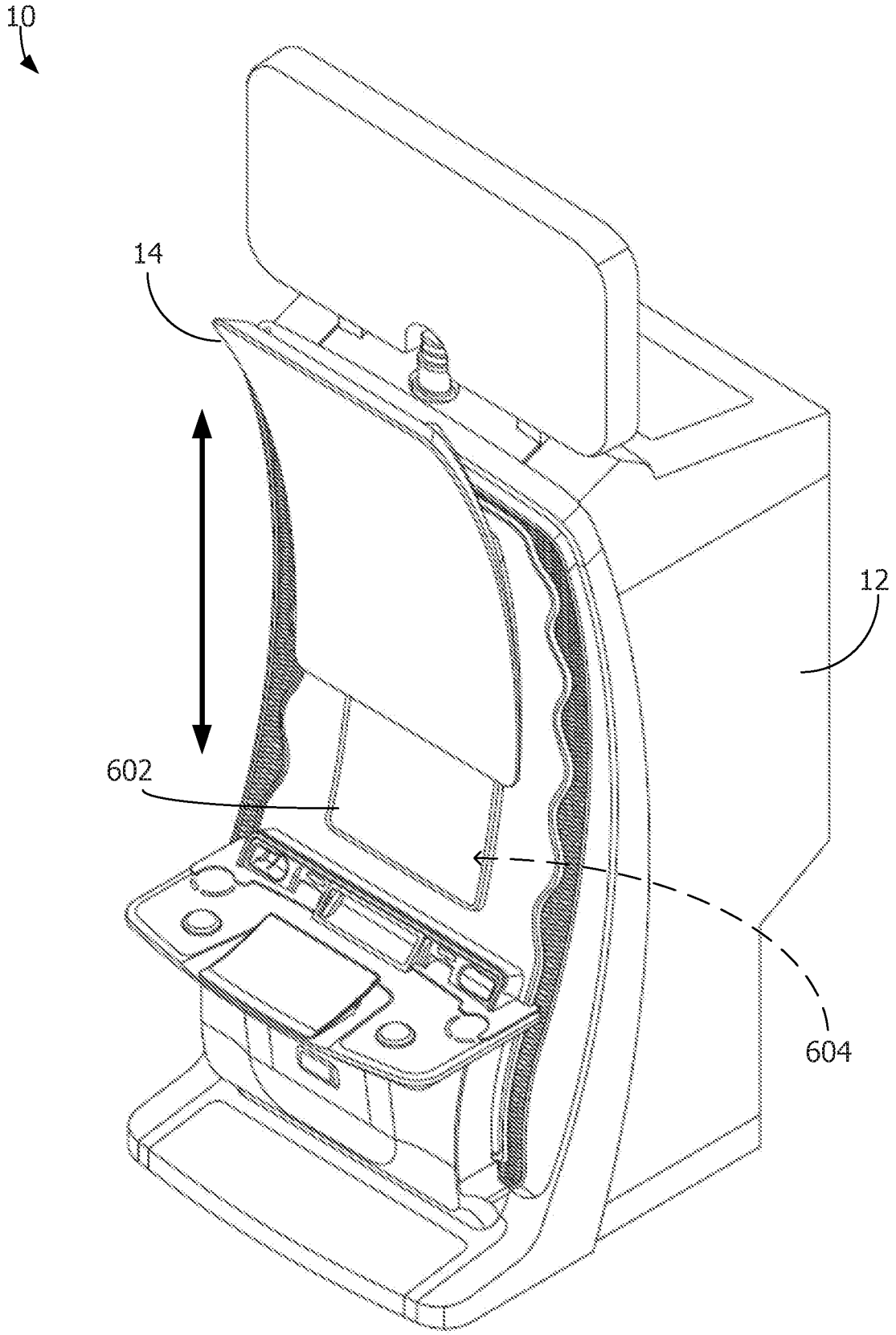
FIG. 6 is a perspective view of the gaming machine shown in FIG. 1 with the primary display in an open position according to an embodiment of the disclosed concepts.
Figure 7:
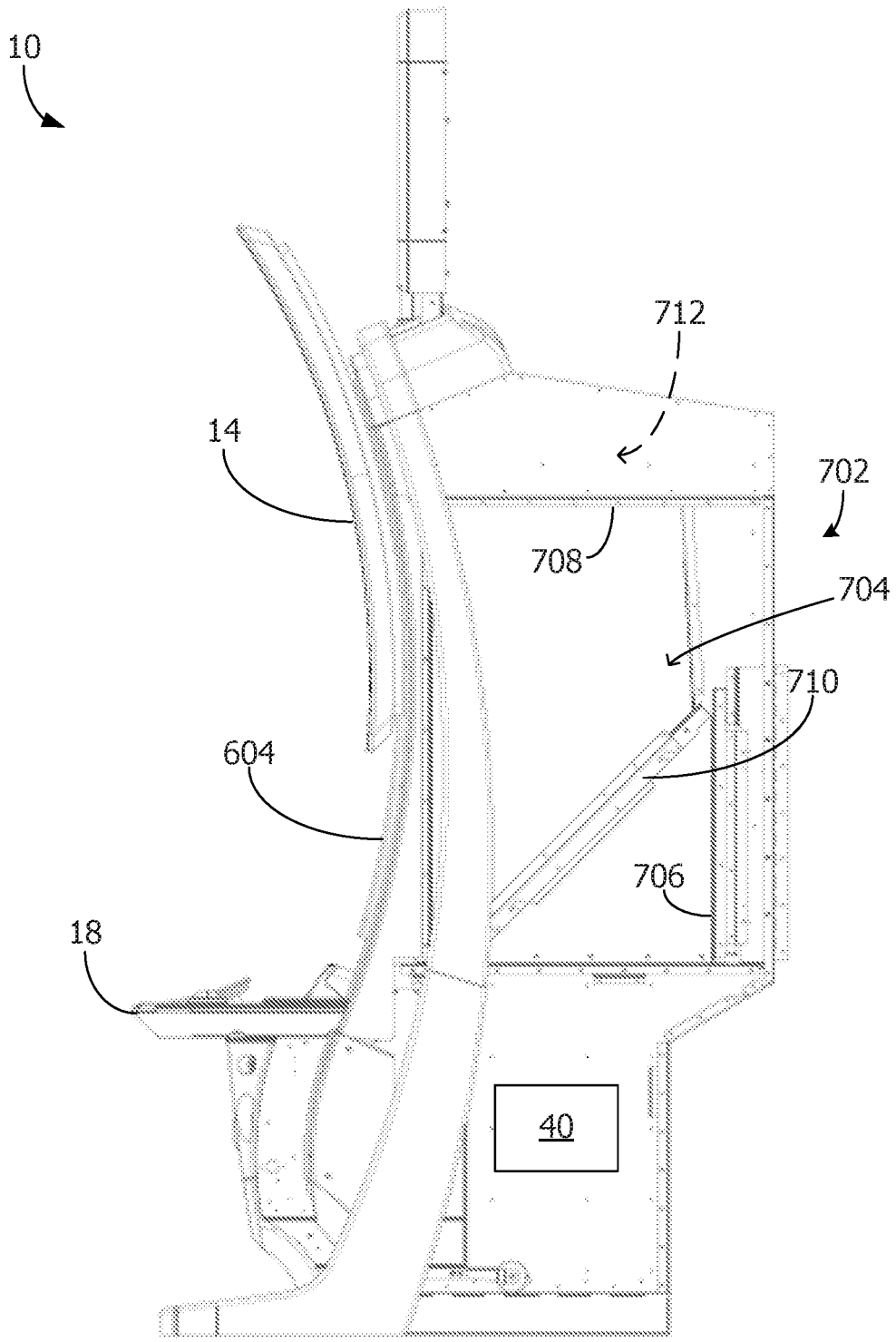
FIG. 7 is a side view of the interior of the gaming machine shown in FIG. 6 according to an embodiment of the disclosed concepts.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. As described above, the gaming cabinet 12 may also take the form of any industrial design and the appearance of the shape/or ornamentation of the gaming cabinet 12 as shown in FIGS. 1, 6, and 7 is merely exemplary.

The input devices, output devices, and input/output devices are disposed on, and securely coupled to, the cabinet 12. By way of example, the output devices include a primary display 14 and a topper display 16. The primary display 14 is a video display device that variously displays information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The primary display 14 may use any suitable display type, such as a liquid-crystal display (LCD), organic light-emitting diode (OLED) display, and the like. In the example embodiment, the primary display 14 is a curved display. In other embodiments, the primary displays may be another suitable curvature, including substantially flat and partially curved (e.g., forming a "J" shape). The topper display 16 may be a video display or another type of display that displays information, attracts nearby potential players, and/or gameplay elements. In one embodiment, the topper display 16 includes a static image exterior and one or more lights that illuminate the static image exterior. The input and output devices of gaming cabinet 12 may vary in number and/or appearance, configuration, location, and proportion and the input and output devices associated with the cabinet 12 as shown in FIGS. 1, 6, and 7 are merely exemplary. For example, the display 14 can be of a different orientation, relative size, or shape.

The gaming machine 10 include a credit input interface 18 and a player input interface 20 that are coupled to the cabinet 12. The credit input interface 18 includes one or more devices configured to receive, scan, and/or dispense physical items associated with a credit (and, in some embodiments, monetary) value for play of a wagering game, such as, but not limited to, currency bills, coins, tokens, tickets, vouchers, coupons, cards, and/or computer-readable storage mediums. That is, the player may provide an item having a credit value to the credit input interface 18 to deposit credits to facilitate subsequent wagers and/or gameplay, and, at the conclusion of a gaming session, the player may receive an item having a credit value from the credit input interface 18 to be used at a subsequent gaming machines or redeemed for an award (e.g., the monetary value corresponding to the credit value). In at least some embodiments, after credits have been provided to the gaming machine 10, a credit meter is established to track the credit value associated with a gaming session in response to wagers, awards, additional credits, and withdrawn credits. Typically, at the end of a gaming session, the credit value indicated by the credit meter is provided to the player via the credit interface 18 and/or applied to a player account associated with the player.

The credit input interface 18 may also include devices and subcomponents that are not directly related to credit input. For example, the credit input interface 18 may include speakers, displays, buttons, lighting configurations, and other suitable devices. In some embodiments, the credit input interface 18 is not a singular interface, but rather is individual modules that may be distributed around the gaming machine 10. It should be understood that numerous other peripheral devices and other elements exist and are readily utilizable in any number of combinations to create various forms of a gaming machine in accord with the present concepts.

The player input interface 20 includes one or more devices for accepting player input and/or display information to the player. For example, the player input interface 20 may include one or more buttons, touchscreens, levers, touchpads, and/or other suitable devices. The player input interface 20 is configured to accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

Figure 2:
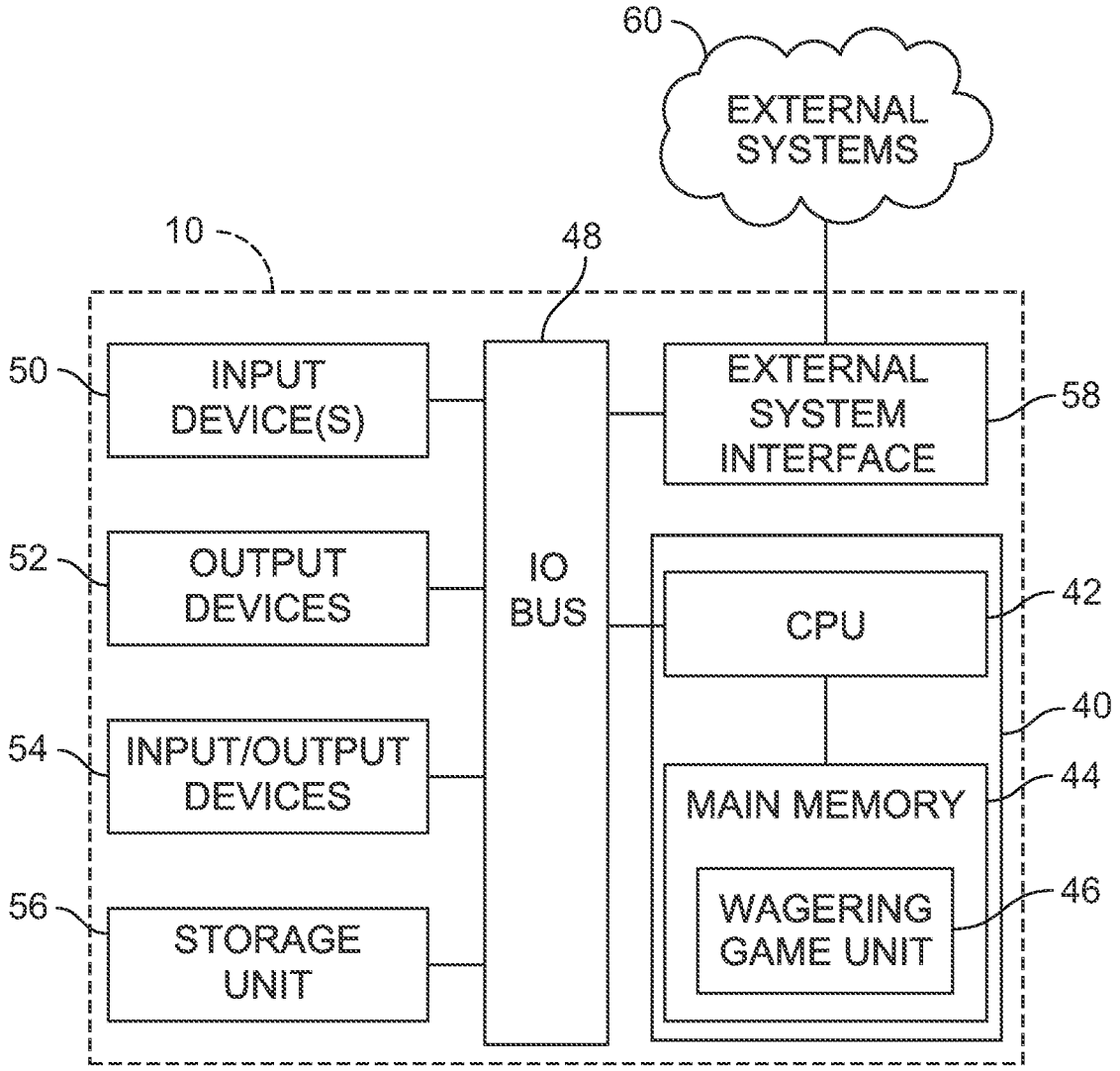
FIG. 2 is a schematic view of a gaming system according to an embodiment of the disclosed concepts.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video blackjack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
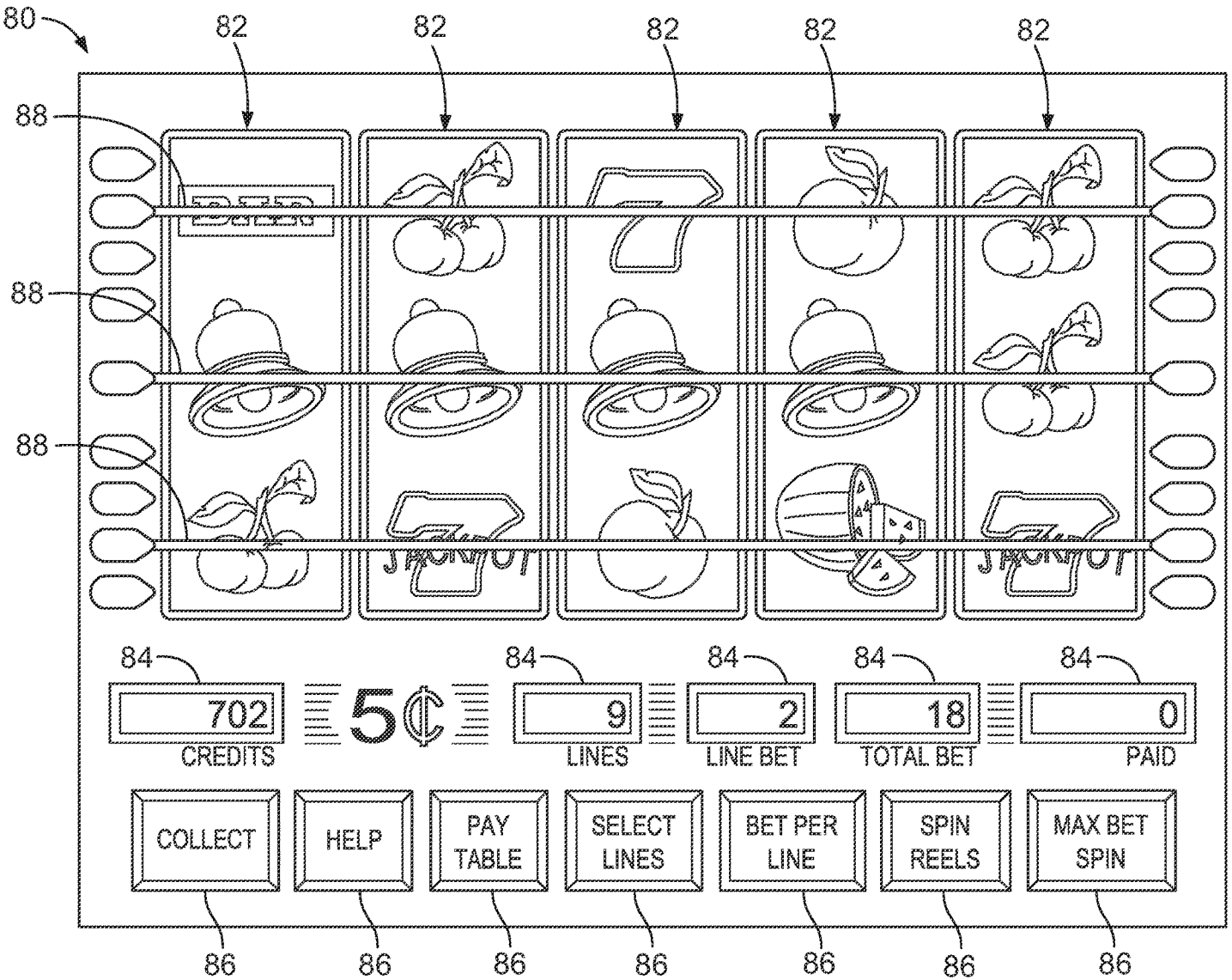
FIG. 3 is a perspective view of the gaming machine shown in FIG. 1 with the primary display in an open configuration according to an embodiment of the disclosed concepts.

Referring now to FIG. 3, there is illustrated an image of a basic-game screen 80 adapted to be displayed on the primary display 14 or another display, including those described elsewhere herein. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 14 or the topper display 16 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 14 or the topper display 16) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 14, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

In the example embodiment, referring again to FIG. 1, the gaming machine 10 is configured to include one or more internal, selectively visible displays. More specifically, the primary display 14 is configured to selectively block visibility to the one or more displays housed within the cabinet 12 of the gaming machine 10. In some embodiments, the primary display 14 is moveable between a closed position (shown in FIG. 1) and an open position that exposes the internal displays as described herein. In other embodiments, the primary display 14 may be selectively transparent to cause the internal displays to be visible. For example, the primary display 14 may be a transmissive display.

In the example embodiment, the gaming machine 10 may also include one or more hidden displays positioned within the gaming machine 10 such that a player located at the player input interface 20 may not directly see the displays even when the interior of the gaming machine 10 is exposed. Although these displays are referred to as "hidden" it is to be understood that the displays may be visible from one or more angles and orientations. However, the hidden displays are positioned to be hidden from players located directly in front of the player input interface 20 for play of a game. To enable the player to view the content displayed by the hidden displays, the gaming machine 10 may include one or more interfaces to reflect the light from the hidden displays towards the player's eyes. As described in detail herein, the interfaces may affect the player's observation of the images from the hidden displays. For example, the images may appear at a depth exceeding the depth of the gaming machine 10.

Figure 4:
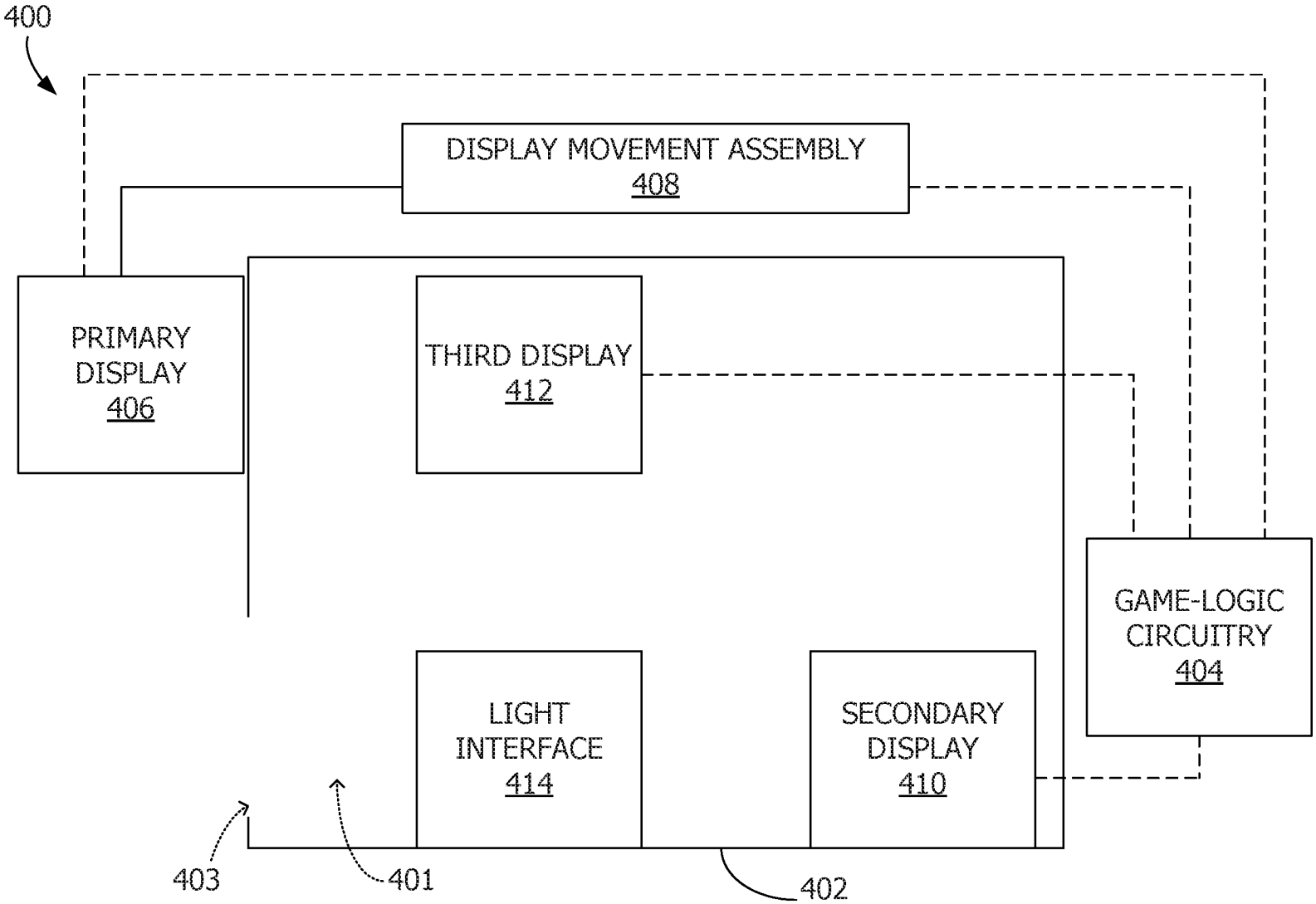
FIG. 4 is a block diagram of an example gaming machine according to an embodiment of the disclosed concepts.

FIG. 4 is a block diagram of an example simplified gaming machine 400. The gaming machine 400 may be substantially similar to the gaming machine 10 (shown in FIG. 1). The gaming machine 400 includes a cabinet 402, game-logic circuitry 404, a primary display 406, a display movement assembly 408, a secondary display 410, a third display 412, and a light interface 414. Although the game-logic circuitry 404 and the display movement assembly 408 as shown outside of the cabinet 402, it is to be understood that the game-logic circuitry 404 and/or the display movement assembly 408 may be positioned within a portion of the cabinet not shown in FIG. 4. In other embodiments, the gaming machine 400 may include additional, fewer, or alternative components, including described elsewhere herein.

The cabinet 402 is configured to at least partially define an internal cavity 401 that houses the secondary display 410, the third display 412, and the light interface 414. In some embodiments, the internal cavity 401 may also include the game-logic circuitry 404 and/or the display movement assembly 408. The cabinet 402 further defines a cavity opening 403 that exposes at least a portion of the internal cavity 401 to visibility outside of the cabinet 402. In particular, at least a portion of the internal cavity 401 including the secondary display 410 is visible when the cavity opening 403 is exposed. In the example embodiment, the primary display 406 is selectively moveable to an open position to expose the cavity opening 403 by the display movement assembly 408. The display movement assembly 408 is coupled to the primary display 406 and causes the primary display 406 to move between the open and closed positions. The display movement assembly 408 may also move the primary display 406 to any suitable number of intermediate positions between the open and closed positions. The display movement assembly 408 may include any suitable components in any suitable configuration to move the primary display 406. In the example embodiment, the game-logic circuitry 404 is communicatively coupled to the display movement assembly 408 to operate the assembly 408. In other embodiments, the gaming machine 400 may not include the display movement assembly 408. In such embodiments, the primary display 406 may be configured to be selectively transparent to expose the cavity opening 403.

The game-logic circuitry 404 is communicatively coupled to the primary display 406, the secondary display 410, and the third display 412 to display game elements and/or other images for play of a game. In some embodiments, the game-logic circuitry 404 causes the primary display 406 to display a first portion of a game and causes the secondary and third displays 410, 412 to display a second portion of the game. In certain embodiments, the first portion of the game is at least partially conducted when the primary display 406 is in the closed position, and the second portion of the game is at least partially conducted when the primary display 406 is in the open position.

The secondary display 410 is positioned such that the secondary display 410 is visible through the cavity opening 403. In the example embodiment, the third display 412 is hidden from view through the cavity opening 403. The third display 412 is positioned above a visible portion of the internal cavity 401. In other embodiments, the third display 412 may be positioned at a different position within the internal cavity, such as below the visible portion of the internal cavity 401. The third display 412 is positioned and oriented relative to the light interface 414 to reflect images towards the players, a surface viewable by the layer, another light interface, and/or other suitable surfaces. In the example embodiment, the light interface 414 is positioned between the cavity opening 403 and the secondary display 410. The light interface 414 in the example embodiment is partially reflective such that images from the secondary display 410 pass through the light interface 414 substantially unimpeded while images from the third display 412 are reflected to the player. The example configuration results in the images from the third display 412 to appear as a virtual image substantially aligned with the images of the secondary display 410 along an axis extending through the cavity opening 403 as described herein. In other embodiments, the gaming machine 400 may not include the third display 412 and the light interface 414 such that only the secondary display 410 revealed in the internal cavity 401.

Figure 5:
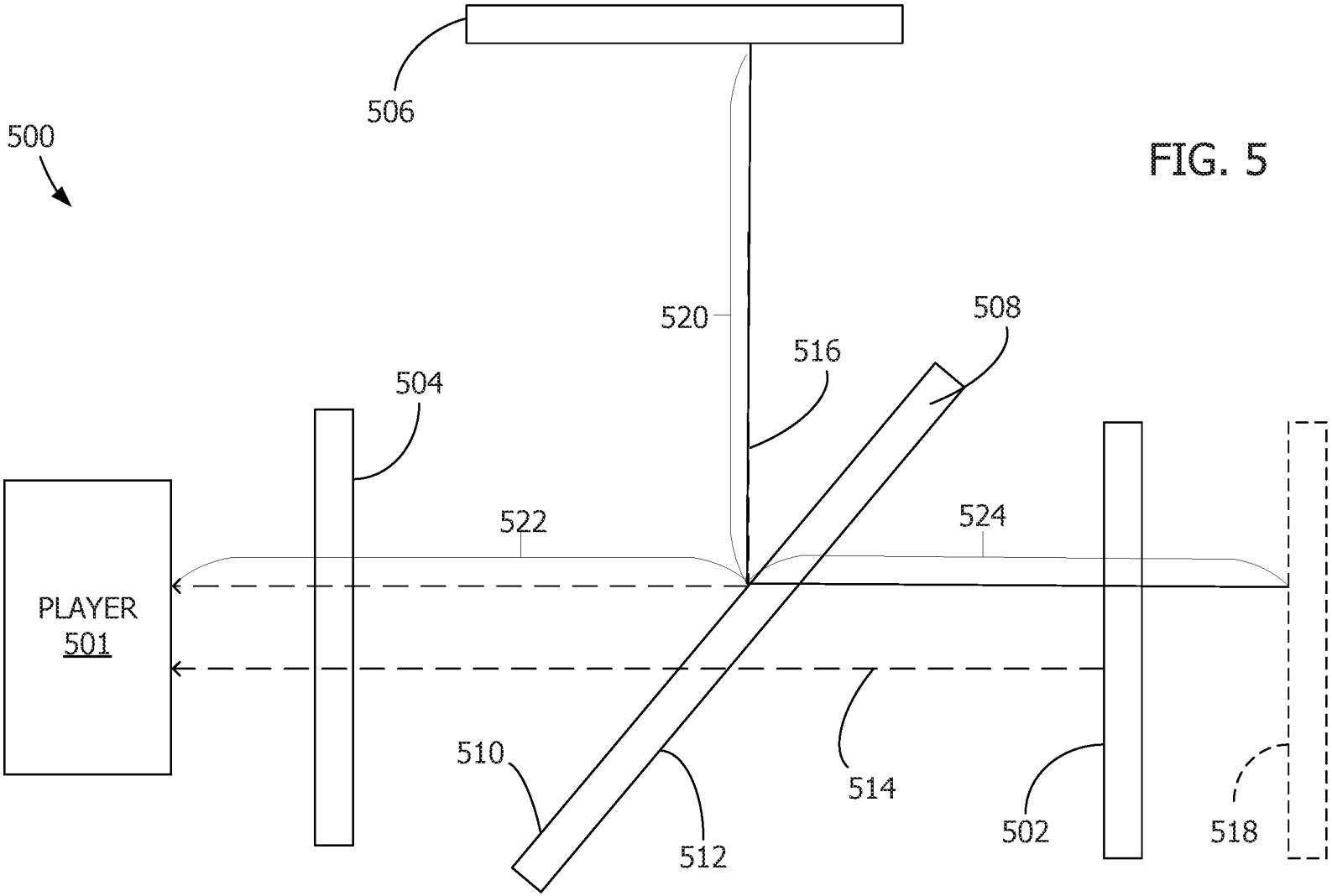
FIG. 5 is a block diagram of an example internal display assembly according to an embodiment of the disclosed concepts.

FIG. 5 is a simplified diagram of an example display assembly 500. The display assembly 500 includes a secondary display 502, a cavity window 504, a third display 506, and a light interface 508. At least a portion of the display assembly 500 may within an internal cavity of a gaming machine. In other embodiments, the display assembly may include additional, fewer, or alternative components in any suitable configuration, including those described elsewhere herein.

The secondary display 502 is directly visible by a player 501 through the cavity window 504. The cavity window 504 is positioned over a cavity opening (e.g., opening 403, shown in FIG. 4) to prevent unauthorized access within the internal cavity. The cavity window 504 is at least partially transparent to facilitate visibility of the secondary display 502. In the example embodiment, the third display 506 is hidden from direct view by the player 501. The light interface 508 is positioned between the secondary display 502 and the player 501. The light interface 508 is configured to reflect at least some light from the third display 506 towards the player 501 while passing at least some of the light from the secondary display 502 to the player 501. As used herein, when referring to light from a display, the "light" includes any images, game elements, and the like displayed by the displays. The light interface 508 is configured to produce a desired balance between the brightness of the secondary display 502 and the third display 506 as seen at the player location. In the most simple configuration the secondary display 502 and third display 506 have equal brightness, and the light interface 508 is configured to pass 50% of the light while reflecting 50% of the light. Other combinations of display brightnesses and light interface reflections are possible.

In the example embodiment, the third display 506 is vertically offset from the light interface 508. The light interface 508 is angled relative to the third display 506 to create an angle of incidence towards the player 501. The light interface 508 includes a reflective surface 510 and a non-reflective surface 512 opposite the reflective surface 510. In the example embodiment, the reflective surface 510 is facing the third display 506 while the secondary display 502 faces the non-reflective surface 512, although this may be reversed in other embodiments. The light interface 508 may be treated or otherwise changed to add the reflective surface 510 and/or the non-reflective surface 512. In one example, the reflective surface 510 may be added to an otherwise non-reflective light interface 508. In the example embodiment, the light interface 508 is a beam splitter. That is, a portion of the light from the third display 506 is reflected, while a portion of the light may pass through the light interface 508 unimpeded. The light interface 508 may be configured to control the amount of reflected light. For example, the light interface 508 may be configured reflect between approximately 45% and 75% of the light emitted by the third display 506. In one example, the light interface 508 is configured to reflect approximately 65% of the light generated by the third display 506. The reflective surface 510 is configured such that light from the secondary display 502 is not reflected when passing through the reflective surface 510.

Exemplary light paths 514, 516 are shown from the secondary and third displays 502, 506, respectively. When the light reaches the player 301, the player 301 observes the images displayed by the secondary display 502 and a virtual image 518 from the third display 506. That is, the images displayed by the third display 506 appear as virtual images 518. The virtual image 518 appears to be aligned with along an axis extending through the cavity window 504 or at least partially overlapping the secondary display 502 as observed by the player 501. In the example embodiment, the virtual image 518 appears behind the secondary display 502. In other embodiments, the virtual image 518 may appear in front of or superimposed with the secondary display 502. The distance at which the virtual image 518 appears is at least partially a function of a first distance 520 between the third display 506 and the light interface 508, and a second distance 522 between the light interface 508 and the player 501. For example, the virtual image 418 appears at a distance that is a combination of the second distance 522 and a third distance 524, which is equal to and varies with the first distance 520. In certain embodiments, the virtual image 518 may even appear at a depth that extends beyond the back of the gaming machine. The virtual depth provided by the display assembly 500 by extending a height of the third display 506 gives the player 501 the perception that the gaming machine is relatively deep without sacrificing floor space to physically add depth. In certain embodiments, the third display 506 may be moveable to selectively adjust the first distance 520, and by extension, the distance at which the virtual image 518 appears (i.e., the third distance 524 varies proportionally to the first distance 520). In such embodiments, third display 506 may be coupled to a dedicated display movement assembly or the same display movement assembly as the primary display (e.g., primary display 406 and display movement assembly 408, both shown in FIG. 4).

FIG. 6 is a perspective view of the gaming machine 10 (shown in FIG. 1) with the primary display 14 in an open position. In the example embodiment, the primary display 14 moves vertically between the open and closed positions. In other embodiments, the primary display 14 may move in a different way. For example, the primary display 14 may move vertically downward or horizontally to the open position. In another example, the primary display 14 may swing away from the cabinet 12 to the open position. In the example embodiment, the gaming machine 10 includes a cavity window 602 positioned over a cavity opening 604.

In other embodiments, the primary display 14 may be a transmissive display or a partially transmissive display. That is, in such embodiments, the primary display 14 may be configured to selectively enable light to pass through the display, thereby enabling an observer to view objects behind the primary display 14 (i.e., the cavity opening 604) without moving the primary display 14. In certain embodiments, the primary display 14 is configured to move and be transmissive. In other embodiments, the primary display 14 is configured to either move or be transmissive. To reveal the cavity opening 604, the primary display 14 may be transmissive at least at a portion of the display 14 that overlaps the cavity opening 604. The logic circuitry 40 (shown in FIG. 2) may be configured to cause the primary display 14 to be selectively transmissive. In certain embodiments including a transmissive primary display 14, the gaming machine 10 may not include the cavity window 602 as the primary display 14 covers the cavity opening 604.

FIG. 7 is a side view of the gaming machine 10 with the side walls removed to show a display assembly 702 within an internal cavity 704 of the gaming machine 10. The display assembly 702 may be substantially similar to the display assembly 500 (shown in FIG. 5). The display assembly 702 includes a secondary display 706, a third display 708, and a light interface 710.

Game-logic circuitry 40 (shown also in FIG. 2) is configured to establish a gaming session in response to player input from the player. In one example, the player provides credits to the gaming machine 10 to fund wagers and/or other credit-based events within the gaming session. The game-logic circuitry 40 is configured to detect one or more trigger conditions to move the primary display 14. The trigger conditions may include, but are not limited to, gameplay events, gameplay conditions, credit conditions (e.g., a large wager is placed, an threshold amount of credits has been added, etc.), player account conditions, and/or other suitable events and conditions that may be monitored by the gaming machine 10. In at least some embodiments, the trigger conditions may prompt the logic circuitry 40 to cause a display movement assembly 712 to move the primary display 14 to the open position and/or the closed position.

In the example embodiment, the primary display 14 in the closed position (shown in FIG. 1) displays a base game portion of the game. When a trigger condition is detected by the logic circuitry 40 during the base game portion of the game, the logic circuitry 40 activates a feature game portion of the game and causes the display movement assembly 712 to move the primary display 14 to the open position. The display assembly 702 and the internal cavity 704 are then exposed to the player at the player input interface 20 via the cavity opening 604 (shown in FIG. 6).

Similar to the display assembly 500 (shown in FIG. 5), the secondary display 706 is visible to the player through the cavity opening 604. The secondary display 706 is configured to display the feature game portion of the game. The light interface 710 is positioned between the cavity opening 604 and the secondary display 706. The third display 708 is offset from the light interface 710 and hidden from direct view by the player. The third display 708 is configured to display one or more virtual game elements for the feature game portion. The virtual game elements may include any suitable symbols, images, and the like that provide visual and/or gameplay enhancement to the images and gameplay displayed by the secondary display 706. Although referred to as "virtual game elements," it is to be understood that the gameplay may be primarily or solely displayed by the third display 708. That is, gameplay may be presented using the secondary display 706 and/or the third display 708, and other visual enhancements that do not affect gameplay may also be presented by the secondary display 706 and/or the third display 708. The virtual game elements are reflected towards the player by the light interface 710 to create a virtual image at a depth as described in FIG. 5.

In response to another trigger condition, the feature game portion is concluded, and the game-logic circuitry 40 causes the display movement assembly 712 to move the primary display 14 to the closed position. In other embodiments, movement of the primary display 14 is not linked to the beginning and end of the feature game portion, but rather is linked to one or more other trigger conditions. In the example embodiment, the base game portion resumes and the primary display 14 rests in the closed position. In some embodiments, while the primary display 14 is in the closed position, at least a portion of the display assembly 702 may powered off or entered into a low-power state. In such embodiments, the game-logic circuitry 40 is configured to activate the display assembly 702 in response to detecting a trigger condition to begin the feature game portion.

Figure 8:
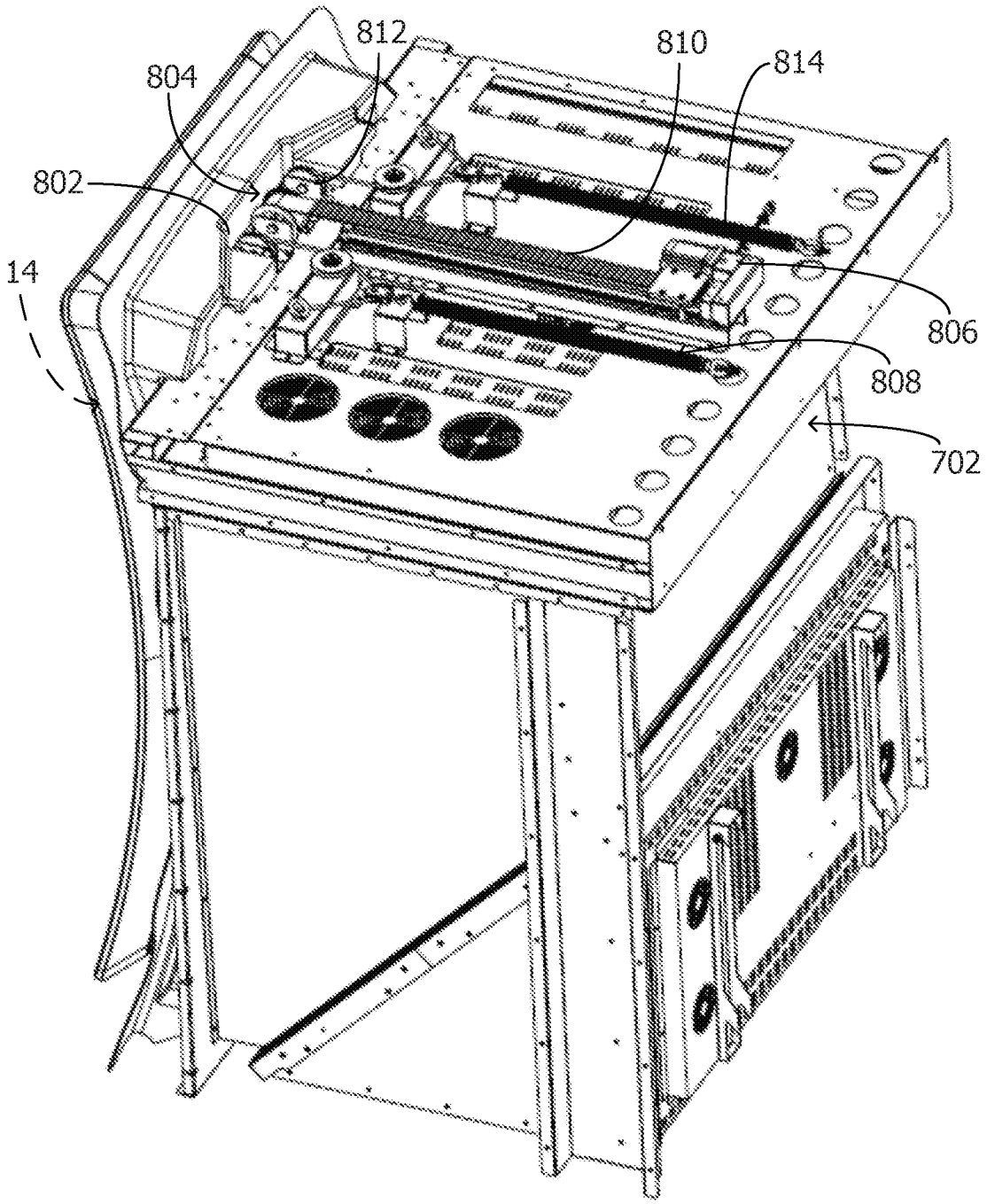
FIG. 8 is a top perspective view of an example display movement assembly according to an embodiment of the disclosed concepts.

FIG. 8 is a perspective view of an example display movement assembly 800. The display movement assembly 800 includes a display cradle 802, a pulley mechanism 804, a motor 806, and a counterbalance assembly 808. In the example embodiment, the display movement assembly 800 is positioned above the display assembly 702 (shown in FIG. 7). In other embodiments, the display movement assembly 800 may include additional, fewer, or alternative components, including those described elsewhere herein.

The display cradle 802 is coupled to the primary display 14 to support and facilitate movement of the display 14. The display cradle 802 may be any suitable configuration to couple to the primary display 14 and the pulley mechanism 804. In the example embodiment, the display cradle 802 is also coupled to the counterbalance assembly 808 as described herein. The display cradle 802 includes one or more grooves, hooks, rails, and the like to couple to the cabinet 12 (shown in FIG. 1) to guide the display cradle 802 and the primary display 14 along a predetermined path between the open and closed positions.

Figure 9:
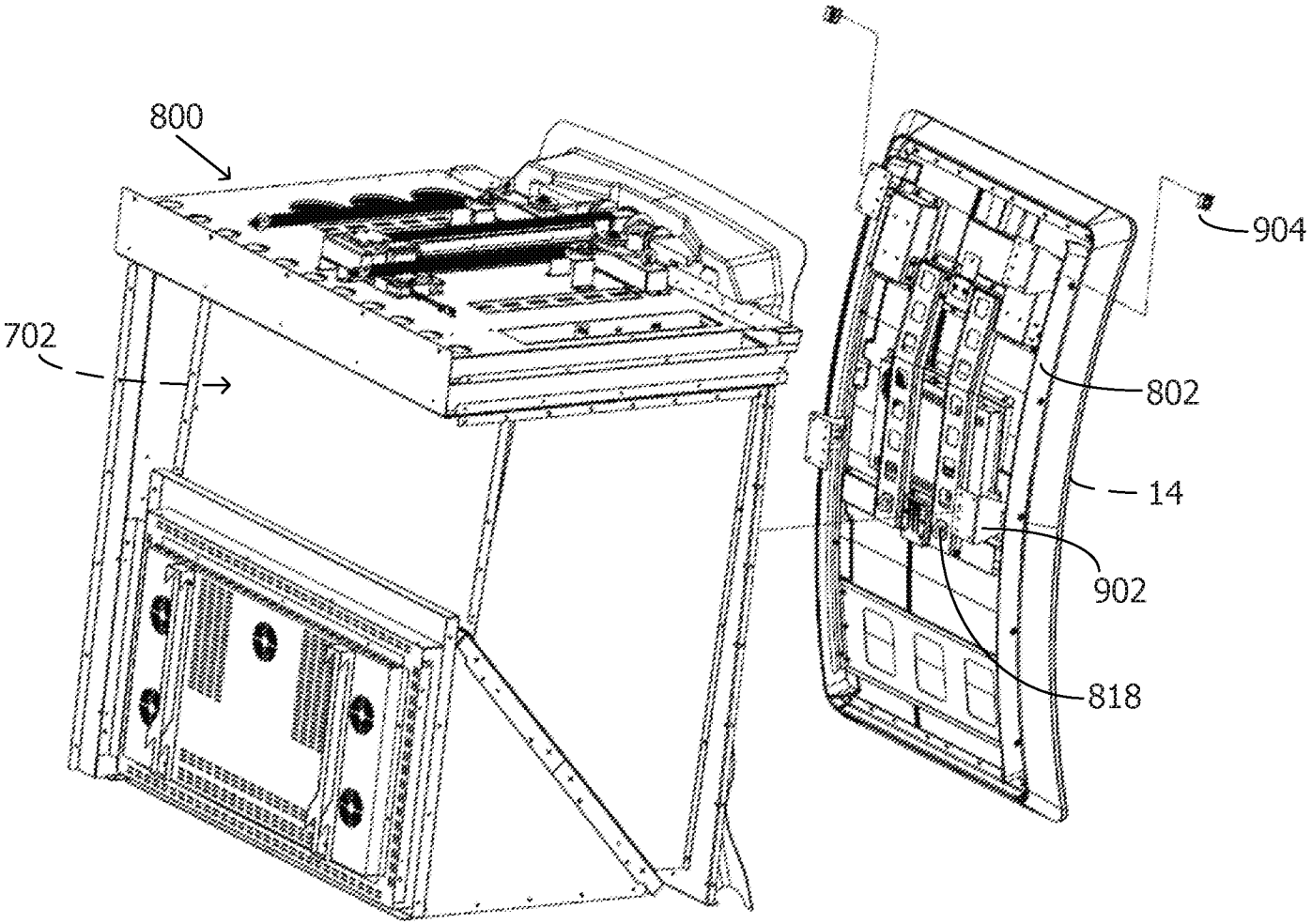
FIG. 9 is a perspective view of an example display cradle according to an embodiment of the disclosed concepts.

FIG. 9 is a perspective view of the display cradle 802. In the example embodiment, the display cradle 802 is coupled to a plurality of guide members 902. The guide members 902 are attached to the cabinet 12 (not shown in FIG. 1). The guide members 902 may include one or more features to couple to the display cradle 802 and permit movement of the cradle 802, such as hooks, rails, grooves, and the like. In one example, the display cradle 802 includes grooves that a portion of the guide members 902 are seated within. In another example, the display cradle 802 is seated within grooves of the guide members 902. The features of the guide members 902 for coupling to the display cradle 802 may vary for each guide member 902. That is, some guide members 902 may include arms configured to extend within grooves of the display cradle 802, while other guide members 902 may include grooves to receive a corresponding portion of the display cradle 802. In the example embodiment, the guide members include sliders 904 that are moveably coupled to the display cradle 802. In certain embodiments, the guide members 902 are integrated with the cabinet 12.

In the example embodiment, the guide members 902 are positioned relative to each other on a curve to facilitate movement of the curved primary display 14. In other embodiments, the guide members 902 may be positioned in a different orientation relative to each other. For example, the guide members 902 may be vertically aligned with each other in two columns, particularly if the primary display 14 is substantially flat. In another example, instead of two columns of guide members 902 positioned near the edges of the display cradle 802, the guide members 902 may be positioned in a single column at the middle of the display cradle 802.

In at least some embodiments, the gaming machine 10 (shown in FIG. 1) may include one or more components or features configured to limit the movement of the primary display 14. That is, the cabinet, the display cradle 802, the guide members 902, and/or another component may include one or more features that prevent further movement of the primary display 14 in a particular direction. These features may interrupt or impede movement of the primary display 14 by physically contacting the display cradle 802 and/or the guide members 902 during movement of the display 14. In certain embodiments, the gaming machine 10 may include one or more sensors to detect the position of the primary display 14 and display cradle 802 relative the movement path. In such embodiments, the data from the sensors may be used (e.g., by the logic circuitry 40 or a controller of the motor 806) to stop movement of the primary display 14, thereby assisting or replacing other the mechanical movement-limiting features of the machine 10.

With reference to FIGS. 8 and 9, the pulley mechanism 804 is coupled between the display cradle 802 and the motor 806 to facilitate movement of the primary display 14 and the display cradle 802. In the example embodiment, the pulley mechanism 804 includes a belt 810 and a pivot wheel 812. The belt 810 is coupled to the display cradle 802 (or, in some embodiments, the primary display 14) and the motor 806. When the primary display 14 is in the closed position, a portion of the belt 810 coupled to the display cradle 802 extends in a relatively vertical orientation while another portion coupled to the motor 806 extends in a relatively horizontal orientation. The pivot wheel 812 is positioned at a transition between these two portions to facilitate movement of the belt 810. More specifically, the motor 806 is configured to cause the belt 810 to selectively retract and extend (i.e., linear actuation) horizontally in the example embodiment. The configuration of the belt 810 and the pivot wheel 812 causes the horizontal movement of the belt 810 to be translated into relatively vertical movement of the display cradle 802 and primary display 14, thereby facilitating movement between the open and closed positions. In other embodiments, the display moment assembly 800 may include additional pulley mechanisms 804, the pulley mechanism 804 in a different configuration, or a different mechanism for moving the primary display 14 and the display cradle 802 (e.g., linearly actuating rails coupled to the cradle 802).

The motor 806 is communicatively coupled to the game-logic circuitry 40 (shown in FIG. 2) to enable the game-logic circuitry 40 to control operation of the motor 806. In at least some embodiments, the motor 806 includes a dedicated controller that receives instructions and/or data from the game-logic circuitry 40 and, in response, controls the activation of the motor 806. In one example, based on one or more detected trigger conditions associated with a gaming session, the game-logic circuitry 40 causes the motor 806 to move the primary display 14 between the open and closed positions via the display cradle and the pulley mechanism 804. In certain embodiments, the display movement assembly 800 may include a plurality of motors 806. In one example, the assembly 800 may include a motor configured to move the primary display 14 to the closed position and another motor configured to move the primary display 14 to the open position.

In at least some embodiments, the counterbalance assembly 808 is coupled to the primary display 14 and/or the display cradle 802 to reduce strain on the motor 806 during movement of the primary display 14. That is, the counterbalance assembly 808 is configured to move in response to movement by the primary display to counteract at least a portion of the weight of the primary display 14 and the display cradle 802. In the example embodiment, the counterbalance assembly 808 includes a pair of springs 814 coupled to a pair of corresponding cables 816. The cables 816 are coupled to the display cradle 802 at hooks 818 (shown in FIG. 9). As the primary display 14 and the display cradle 802 are lowered to the closed position, the springs 814 are stretched from a resting position. The resulting spring force eases a portion of the burden maintained by the pulley mechanism 804 and the motor 806 and may facilitate smoother movement between the open and closed positions. In other embodiments, the counterbalance assembly 808 may include additional, fewer, or alternative components in any suitable configured to counteract the weight of the primary display 14 and the display cradle 802. For example, the counterbalance assembly 808 may include one or more counterweights configured to move in a direction opposite of the primary display 14. In certain embodiments, the display movement assembly 800 does not include a counterbalance assembly 808. That is, the pully mechanism 804 and the motor 806 may operate to move the primary display without the assistance of the counterbalance assembly 808.

Figure 10:
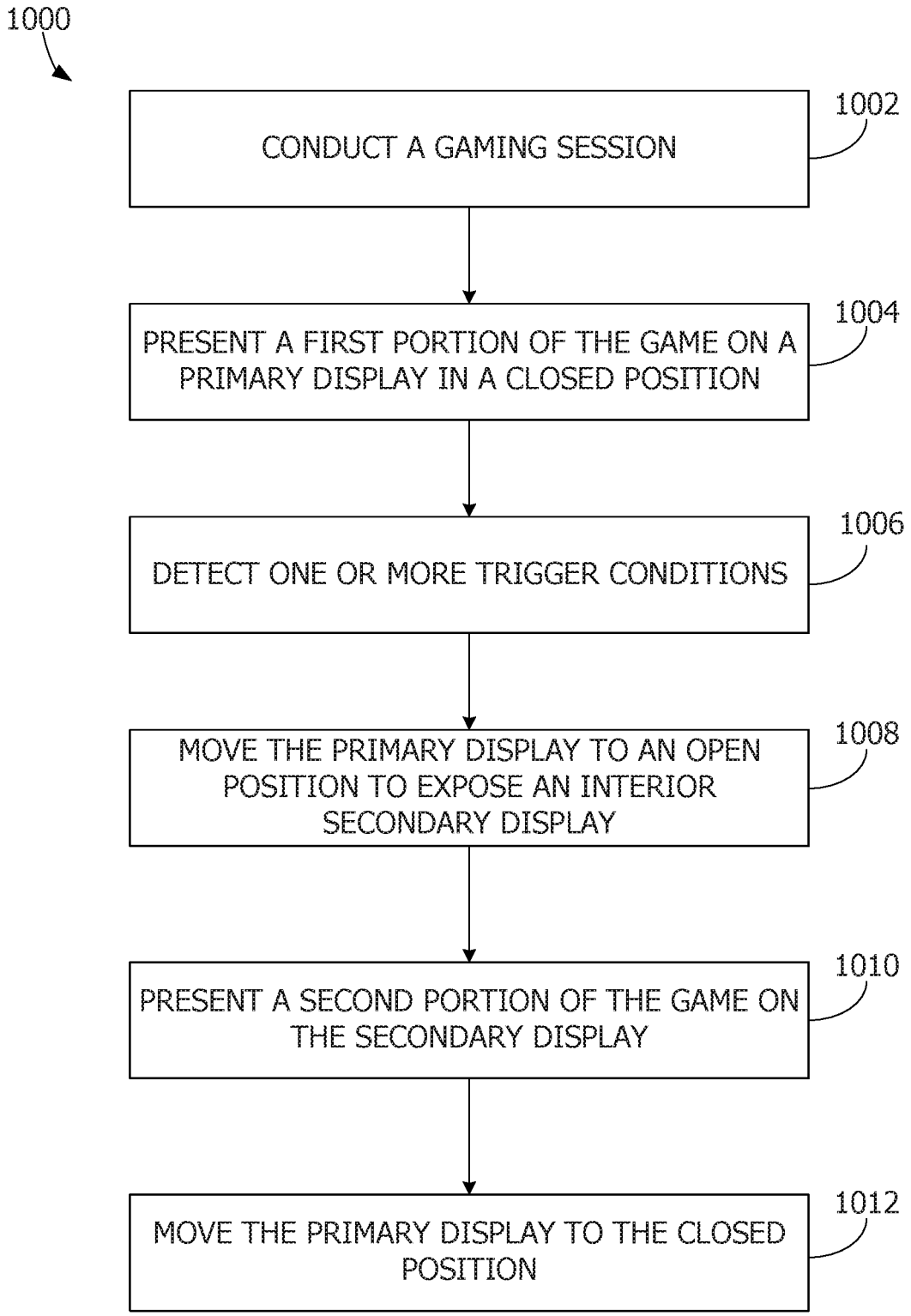
FIG. 10 is a flow diagram of an example method of operating a game machine with a moveable primary display according to an embodiment of the disclosed concepts.

FIG. 10 is a flow diagram of an example method 1000 for revealing a hidden display of a gaming machine according to an embodiment of the disclosed concepts. The method 1000 may be at performed using the gaming machine 10 shown in FIG. 1 and the gaming system shown in FIG. 2. In other embodiments, the method 1000 may include additional, fewer, or alternative steps that may be performed by any suitable device or component, including those described elsewhere herein.

In the example embodiment, with reference to FIGS. 1, 7, and 10, the gaming machine 10 conducts 1002 a gaming session of a game. In some embodiments, the game is a wagering game, and the gaming sessions is established in response to a credit input provided by a player at the gaming machine 10 to facilitate placing one or more wagers. The gaming session continues until an ending condition is reached or detected, such as the player manually terminating the gaming session, no player input detected for a predetermined amount of time, or a credit meter reaching zero available credits. In at least some embodiments, the primary display 14 may be in the closed position at the beginning of a gaming session. During the gaming session, the primary display 14 in the closed position presents 1004 a first portion of the game. In the example embodiment, the first portion of the game is a base game portion of the game. In some embodiments, the first portion of the game is presented on a plurality of displays and touchscreens including the primary display 14.

The game-logic circuitry 40 then detects 1006 one or more trigger conditions to initiate a second portion of the game. In the example embodiment, the second portion of the game is a feature game portion of the game. The trigger conditions include various detectable factors that are monitored by the game-logic circuitry 40 (or a device communicatively coupled to the logic circuitry 40). The trigger conditions may include, but are not limited to, events and states associated with gameplay, credit amount, wager amount, historical player data, gaming machine data, time, random selection, presence data, and/or community data. For example, the trigger condition may be a particular winning outcome of the first portion of the game, a cumulative wager amount exceeded a predetermined threshold, or the player playing a predetermined number of games over a period of time. In some embodiments, multiple trigger conditions must be satisfied to cause the logic circuitry 40 to initiate the second portion of the game.

In response to detecting the one or more trigger conditions, the game-logic circuitry 40 causes the display movement assembly 712 to move 1008 the primary display 14 to the open position, thereby exposing the internal cavity 704 via the cavity opening 604. When the internal cavity 704 is exposed to the player, the game-logic circuitry 40 causes the secondary display 706 to present 1010 the second portion of the game. In the example embodiment, the game-logic circuitry 40 also causes the third display 708 to present virtual game elements for the second portion of the game as described herein. In one example, the virtual game elements include a plurality of reels and the secondary display 706 displays graphical objects and backgrounds to enhance the reels displayed by the third display 708. In another example, gameplay is presented by the secondary display 706 while the third display 708 presents virtual game elements that visually enhance the gameplay on the secondary display 706. In yet another example, game elements associated with gameplay and/or visual enhancements are jointly presented by the secondary display 706 and the third display 708. In other embodiments in which the gaming machine 10 does not include the third display 708, the secondary display 706 may present the entirety of the second portion of the game. As the second portion of the game is conducted, the game-logic circuitry 40 monitors one or more termination trigger conditions similar to the trigger conditions detected 1006 by the game-logic circuitry 40. Detection of the termination trigger conditions causes the game-logic circuitry to terminate the second portion of the game and restart the first portion of the game (or initiate a third portion of the game). To restart the first portion of the game, the game-logic circuitry 40 causes the display movement assembly 712 to move 1012 the primary display 14 back to the closed position to block the internal cavity 704 from view. Steps 1004-1012 may then be repeated until termination of the gaming session.

Although the example embodiment described above refers to the first portion as a base game portion and the second portion as a feature game portion, it is to be understood that the first portion may be a feature game portion and/or the second portion may be a base game portion in other embodiments. In one example, when the gaming session is initiated, the primary display 14 is in the open position and the second portion of the game is conducted. In this example, the trigger conditions detected 1006 by the game-logic circuitry 40 cause the logic circuitry 40 to initiate the first portion of the game and the display movement assembly 712 to move the primary display to the closed position.

In certain embodiments, the third display 708 may be configured to present a third portion of the game separate from the second portion of the game. That is, in response to the primary display 14 being moved to the open position, the game-logic circuitry 40 may conduct either the second or third portions of the game. The second and third portions may have separate trigger conditions to determine which portion of the game to conduct. In one example, the second portion of the game is one or more video clips presented to the player, and the third portion of the game is a slot or reel-based game.

Figure 11:
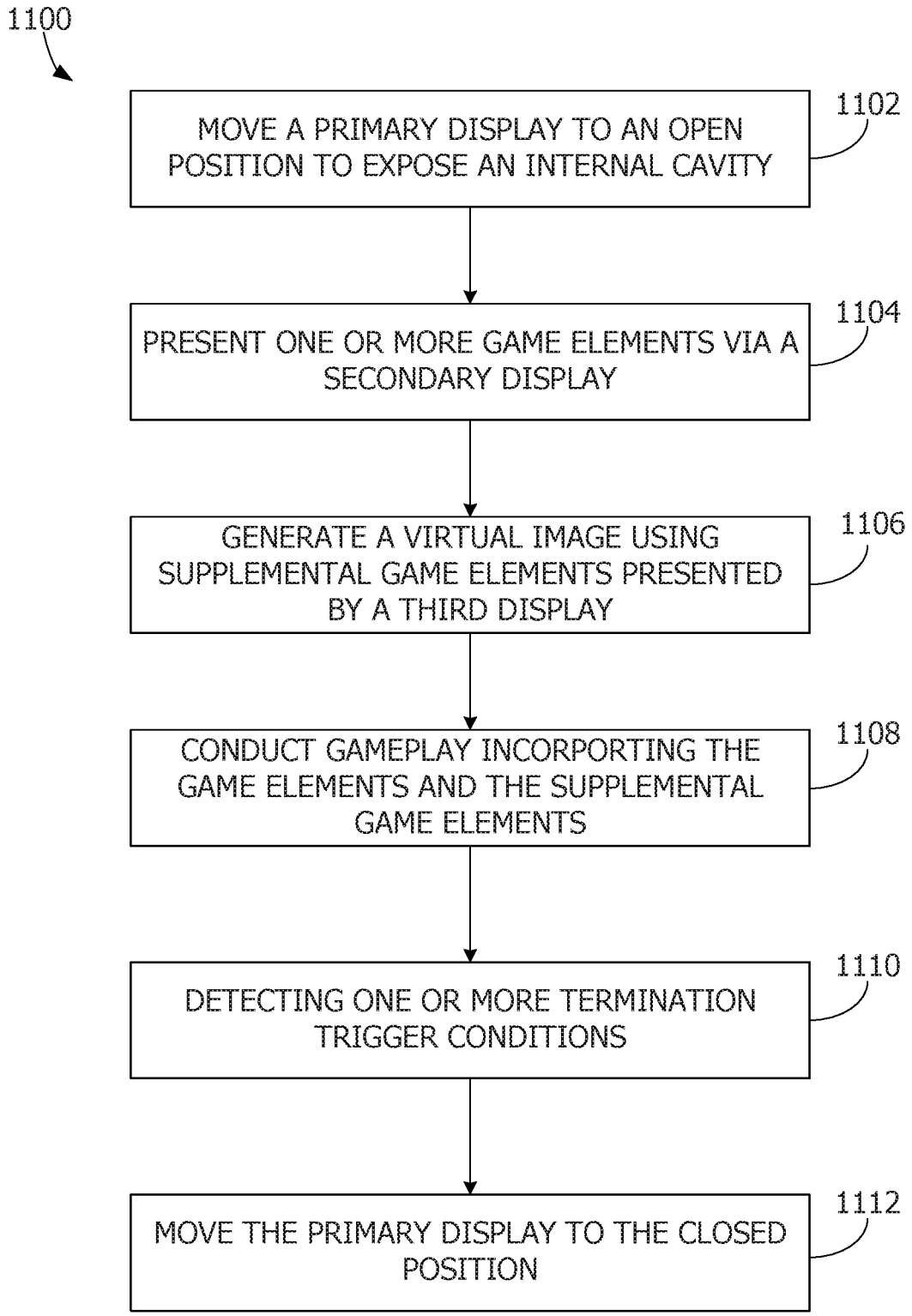
FIG. 11 is a flow diagram of an example method of displaying virtual images with a gaming machine according to an embodiment of the disclosed concepts.

FIG. 11 is a flow diagram of an example method 1100 for displaying game elements using hidden displays of a gaming machine, such as the gaming machine 10 (shown in FIG. 1). In other embodiments, the method 1100 may include additional, fewer, or alternative steps performed by any suitable device or component, including those described elsewhere herein.

With reference to FIGS. 1, 7, and 11, the game-logic circuitry 40 causes the display movement assembly 712 to move 1102 the primary display 14 to the open position to expose the internal cavity 704. In the example embodiment, the game-logic circuitry 40 then causes the secondary display 706 to present 1104 one or more game elements. As set forth above, the game elements may be any visual element associated with a portion of the game and may include visual elements that depict gameplay such that symbol reels, visual elements not actively involved in gameplay (e.g., background images, video clips, etc.), and the like.

In the example embodiment, the game-logic circuitry 40 causes the third display 708, in combination with the light interface 710, to generate 1106 a virtual image. More specifically, the third display 708 presents one or more virtual game elements towards the light interface 710, which reflects at least a portion of the light emitted by the third display 708 towards the player, thereby causing the one or more virtual game elements to appear as a virtual image to the player. In the example embodiment, the virtual image appears to the player to be located behind the secondary display 706 such that the secondary display and the virtual image appear to be at least partially overlapping. In other embodiments, the virtual image may appear at a different position relative to the secondary display 706 and/or with a different amount of overlap (including none) between the secondary display 706 and the virtual image.

In the example embodiment, the game-logic circuitry 40 conducts 1108 gameplay of the game incorporating the game elements presented by the secondary display 706 and the virtual game elements presented by the third display 708. Game elements associated with gameplay may be presented by the secondary display 706 and/or the third display 708. As game events occur that alter the presented game elements, the game-logic circuitry 40 updates the secondary display 706 and the third display 708 synchronously such that alterations to the game elements appear to be relatively seamless between the secondary display 706 and the virtual image.

The game-logic circuitry 40 then detects 1110 one or more termination trigger conditions, and in response to the detected termination trigger conditions, the game-logic circuitry 40 causes the display movement assembly 712 to move 1112 the primary display 14 to the closed position, thereby blocking player visibility within the internal cavity 704. In some embodiments, in response to the primary display moving to the closed position, the game-logic circuitry 40 may cause the secondary display 706 and the third display 708 to enter a low-power or off state until the internal cavity 704 is exposed.

As described above with respect to the external aspects of the cabinet 12, the internal aspects, including the physical and virtual display elements can vary in number and/or appearance, configuration, location, and proportion and the appearances of these features as shown in the figures are merely exemplary.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming machine comprising:

a cabinet at least partially defining an internal cavity and a cavity opening, wherein at least a portion of the internal cavity is visible through the cavity opening;

a primary display;

a secondary display positioned within the internal cavity, the secondary display visible through the cavity opening;

a display movement assembly coupled to the primary display, the display movement assembly configured to selectively move the primary display between an open position and a closed position, wherein the primary display in the closed position blocks visibility through the cavity opening; and logic circuitry configured to:

cause the primary display in the closed position to present a first portion of a game;

cause the display movement assembly to move the primary display to the open position to expose the cavity opening and the secondary display; and in response to the secondary display being exposed, cause the secondary display to present a second portion of the game.

2. The gaming machine of claim 1 further comprising:

a light interface positioned within the internal cavity between the cavity opening and the secondary display; and a third display positioned within the internal cavity and offset from the light interface, the light interface angled to reflect light from the third display towards the cavity opening and pass light from the secondary display to the cavity opening.

3. The gaming machine of claim 2, wherein the logic circuitry is further configured to cause the third display to present a virtual game element associated with the game, the light interface causing the virtual game element to appear as a virtual image substantially aligned with the secondary display along an axis extending through the cavity opening to a player observing the secondary display through the cavity opening.

4. The gaming machine of claim 2, wherein the third display is offset above the light interface out of direct visibility of the player viewing the secondary display.

5. The gaming machine of claim 1, wherein the display movement assembly comprises a motor communicatively coupled to the logic circuitry, the motor configured to selectively activate to move the primary display between the open position and the closed position.

6. The gaming machine of claim 5, wherein the display movement assembly further comprises:

a display cradle coupled to the primary display;

at least one guide member coupled to the display cradle, the guide member configured to guide movement of the primary display and the display cradle between the open position and the closed position; and a pulley mechanism coupled to the display cradle and the motor, the pulley mechanism configured to move the primary display in response to the motor activating.

7. The gaming machine of claim 5, wherein the display movement assembly further comprises a counterbalance assembly coupled to the display cradle, the counterbalance assembly including at least one of a spring or a counterweight.

8. The gaming machine of claim 1, wherein the first portion of the game is a base game portion and the second portion of the game is a feature game portion activated in response to a trigger condition associated with the base game portion, the logic circuitry configured to cause the display movement assembly to move the primary display to the open position in response to the trigger condition.

9. The gaming machine of claim 1 further comprising a cavity window covering the cavity opening, wherein the cavity window is substantially transparent such that the secondary display is visible through the cavity window.

10. A method of revealing hidden displays using a gaming machine, the gaming machine including a cabinet at least partially defining an internal cavity and a cavity opening, a primary display, and a secondary display positioned within the internal cavity, the secondary display visible through the cavity opening, the method comprising:

moving, by a display movement mechanism of the gaming machine, the primary display to a closed position, wherein the primary display in the closed position blocks visibility through the cavity opening to the secondary display;

presenting, by the primary display in the closed position, a first portion of a game;

in response to one or more trigger conditions, moving, by the display movement assembly, the primary display to an open position to expose the cavity opening and the secondary display; and in response to the secondary display being exposed, presenting, by the secondary display, a second portion of the game.

11. The method of claim 10, wherein the gaming machine further includes a light interface positioned within the internal cavity between the cavity opening and the secondary display and a third display positioned within the internal cavity and offset from the light interface, the method further comprising:

presenting, by the third display, a virtual game element associated with the second portion of the game, wherein the light interface causes the virtual game element to appear as a virtual image at a distance substantially aligned with the secondary display along an axis extending through the cavity opening to a player observing the secondary display through the cavity opening.

12. The method of claim 11, wherein the light interface includes a partially reflective surface.

13. The method of claim 11, wherein the third display is offset above the light interface out of direct visibility of the player viewing the secondary display.

14. The method of claim 10, wherein moving the primary display to the closed position and moving the primary display to the open position further comprises selectively activating, by logic circuitry of the gaming machine, a motor of the display movement assembly to move the primary display between the closed position and the open position.

15. The method of claim 14, wherein the display movement assembly further includes a display cradle coupled to the primary display, a pulley mechanism coupled to the motor, and at least one guide member coupled to the display cradle, wherein moving the primary display to the open position further comprises:

pulling, by the pulley mechanism, the display cradle towards the open position in response to the motor activating; and guiding, by the at least one guide member, the display cradle and the primary display towards the open position along a predetermined movement path.

16. The method of claim 14 further comprising, in response to the display movement assembly moving the primary display, moving a counterbalance assembly to counteract at least a portion of the weight of the primary display.

17. The method of claim 10, wherein the first portion of the game is a base game portion and the second portion of the game is a feature game portion activated in response to a trigger condition associated with the base game portion.

18. A gaming system comprising:

a gaming machine comprising:

a cabinet at least partially defining an internal cavity and a cavity opening, wherein at least a portion of the internal cavity is visible through the cavity opening;

a primary display;

a secondary display positioned within the internal cavity, the secondary display visible through the cavity opening; and a display movement assembly coupled to the primary display, the display movement assembly configured to selectively move the primary display between an open position and a closed position, wherein the primary display in the closed position blocks visibility through the cavity opening; and logic circuitry configured to:

cause the primary display in the closed position to present a first portion of a game;

cause the display movement assembly to move the primary display to the open position to expose the cavity opening and the secondary display; and in response to the secondary display being exposed, cause the secondary display to present a second portion of the game.

19. The gaming system of claim 18, wherein the gaming machine further comprises:

a light interface positioned within the internal cavity between the cavity opening and the secondary display; and a third display positioned within the internal cavity and offset from the light interface, the light interface angled to reflect light from the third display towards the cavity opening and pass light from the secondary display to the cavity opening.

20. The gaming system of claim 19, wherein the logic circuitry is further configured to cause the third display to present a virtual game element associated with the game, the light interface causing the virtual game element to appear as a virtual image at a distance substantially aligned with the secondary display along an axis extending through the cavity opening to a player observing the secondary display through the cavity opening.

* * * * *